US006805387B1

(12) United States Patent
Williams et al.

(10) Patent No.: US 6,805,387 B1
(45) Date of Patent: Oct. 19, 2004

(54) LATCH

(75) Inventors: David Jonathon Williams, Willenhall (GB); Mark Hao LI, Birmingham (GB)

(73) Assignee: Meritor Light Vehicle Systems (UK) Limited (GB)

( * ) Notice: Subject to any disclaimer, the term of this patent is extended or adjusted under 35 U.S.C. 154(b) by 0 days.

(21) Appl. No.: 10/048,541

(22) PCT Filed: May 11, 2000

(86) PCT No.: PCT/GB00/01796

§ 371 (c)(1),
(2), (4) Date: Jun. 3, 2002

(87) PCT Pub. No.: WO00/70177

PCT Pub. Date: Nov. 23, 2000

(Under 37 CFR 1.47)

(30) Foreign Application Priority Data

May 15, 1999 (GB) ..... 9911263

(51) Int. Cl.[7] ..... E05C 3/06
(52) U.S. Cl. ..... 292/216; 292/DIG. 43
(58) Field of Search ..... 292/201, 216, 292/DIG. 23, DIG. 43

(56) References Cited

U.S. PATENT DOCUMENTS

| | | | | | |
|---|---|---|---|---|---|
| 3,785,186 | A | * | 1/1974 | James et al. | 70/240 |
| 4,395,064 | A | * | 7/1983 | Bellot | 292/201 |
| 4,974,885 | A | | 12/1990 | Yokoyama | |
| 5,074,603 | A | * | 12/1991 | Brackmann | 292/216 |
| 5,137,311 | A | * | 8/1992 | Brackmann | 292/216 |
| 5,445,326 | A | * | 8/1995 | Ferro et al. | 292/336 |
| 5,897,148 | A | * | 4/1999 | Arabia et al. | 292/216 |
| 5,979,951 | A | * | 11/1999 | Shimura | 292/216 |
| 6,247,732 | B1 | * | 6/2001 | Alton | 292/216 |
| 6,267,420 | B1 | * | 7/2001 | Miyagawa | 292/216 |
| 6,364,379 | B1 | * | 4/2002 | Roberts | 292/216 |
| 6,378,920 | B1 | * | 4/2002 | Ostrowski | 292/216 |

FOREIGN PATENT DOCUMENTS

| | | |
|---|---|---|
| GB | 1 569 095 | 6/1980 |
| GB | 2 162 234 A | 1/1986 |
| WO | WO 95/09289 | 4/1995 |

OTHER PUBLICATIONS

Search Report dated Aug. 24, 1999.

* cited by examiner

*Primary Examiner*—Gary Estremsky
(74) *Attorney, Agent, or Firm*—Carlson, Gaskey & Olds

(57) ABSTRACT

A latch including bolt moveable between a latched position at which it is capable of retaining a striker in an engaged position an and unlatched position at which at the striker is free to move between the engaged position and a remote position and a first retaining means moveable between a retaining position at which it retains the latch bolt in its latched position and a released position at which it releases the latch bolt from its latched position and a second retaining means for releasably retaining the first retaining means in its released position following unlatching of the latch, the second retaining means further retaining the first retaining means in its released position following movement of a striker from the remote position to the engaged position.

23 Claims, 4 Drawing Sheets

LATCH

BACKGROUND OF THE INVENTION

The present invention relates to latch mechanism and in particular latch mechanisms for securing boot lids (doors) of automobiles.

Latches for securing boot lids in a closed position are known. Typically when the boot lid is slammed shut the latch will retain the boot lid in a closed position. However instances have been recorded where people in particular children have climbed into a boot and slammed the boot lid closed whilst inside the boot, and have then been unable to exist the boot. This is clearly a safety hazard.

An object of the present invention is to provide a latch in which accidental trapping of children is less likely to occur.

SUMMARY OF THE INVENTION

Thus according to the present invention there is provided a latch including a latch bolt moveable between a latched position at which it is capable of retaining a striker in an engaged position and an unlatched position at which at striker is free to move between the engaged position and a remote position and a first retaining means moveable between a retaining position at which it retains the latch bolt in its latched position and a released position at which it releases the latch bolt from its latched position and a second retaining means for releasably retaining the first retaining means in its released position following unlatching of the latch, the second retaining means further retaining the first retaining means in its released position following movement of a striker from the remote position to the engaged position.

In some embodiments the second retaining means can be temporarily retained in a position at which it releases the first retaining means. This allows the second retaining means to be overridden and would typically be used when there is a reduced likelihood of trapping children, such as on a car owned by a family having no young children.

BRIEF DESCRIPTION OF THE DRAWINGS

The invention will now be described by way of example only, with reference to the accompanying drawings, in which.

DETAILED DESCRIPTION OF A PREFERRED EMBODIMENT

Figure 1:
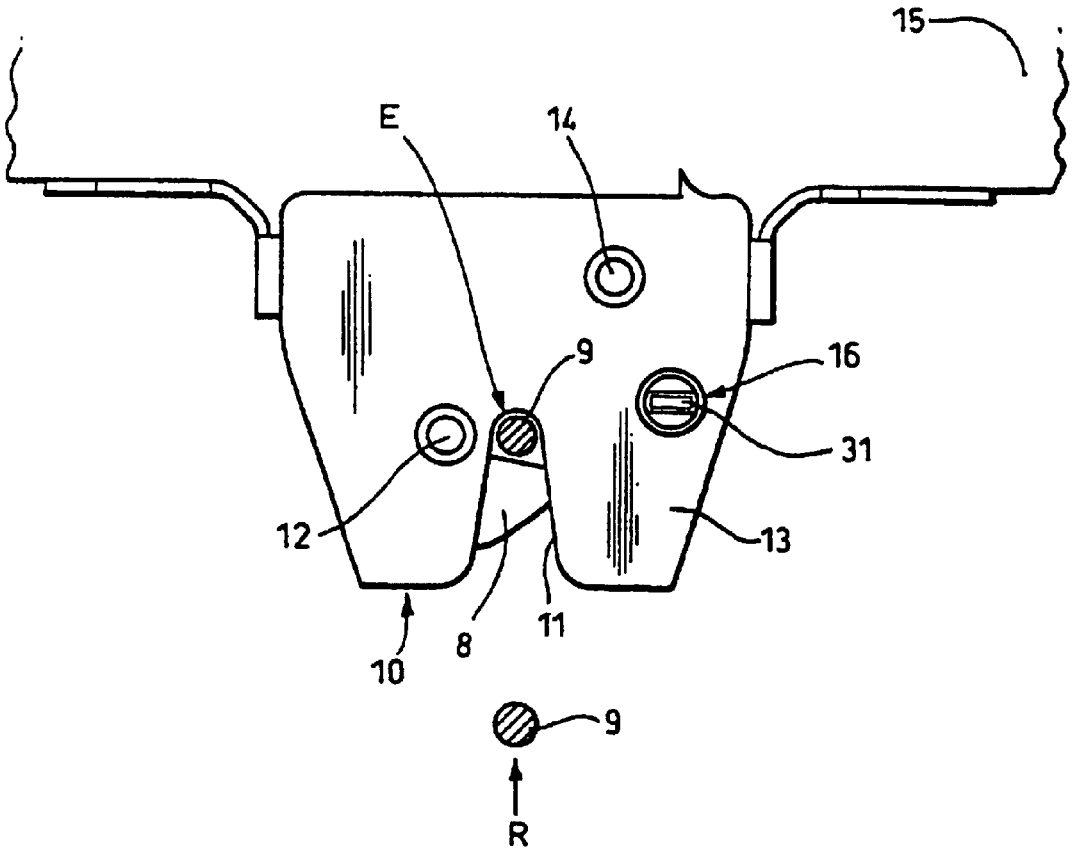
FIG. 1 is a view of a latch assembly according to the present invention.

With reference to the figures there is shown a latch assembly 10 (see FIG. 1) secured to a boot lid 15. The latch assembly includes a latch housing 13 having a latch mouth 11. Various components are contained within the latch housing including a latch bolt in the form of a latch claw 8 being rotatable about latch claw pivot 12, a first retaining means in the form of a pawl 18 (see FIG. 1A) rotatable in a general plane P2 about pawl pivot 14 and a second retaining means in the form of a pawl retainer 16.

With the boot lid in the open position, a striker pin 9, fixed to the body of the vehicle, is a remote position R relative to the latch assembly 10.

As boot lid is closed the striker pin 9 moves from the remote position and enters latch mouth 11 and adopts an engaged position E where it is retained by the claw 8 with the pawl 18 acting to retain the claw 8 in its first latched position. Movement of the pawl 18 from its first retaining position to its second released position allows the claw 8 to move from its first latched position to its second unlatched position thus releasing the boot lid 15 for opening. The claw 8 is biased towards its second unlatched position by a bias means (not shown).

Figure 1A:
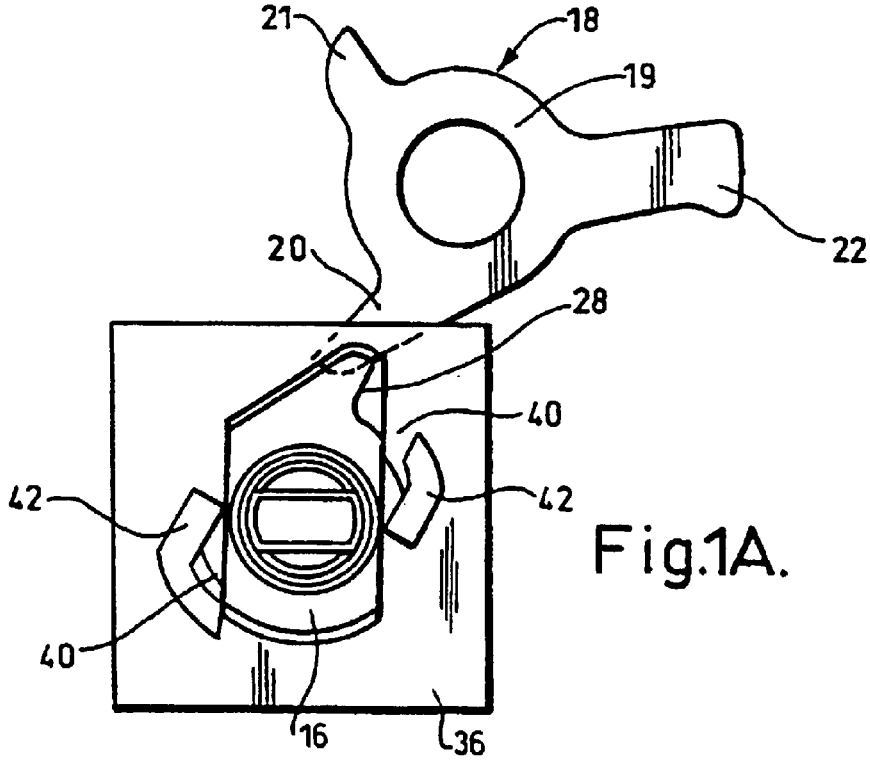
FIG. 1A is a view of a pawl in a first retaining position, a pawl retainer in a first released position, and fixed structure of the latch assembly of FIG. 1.
Figure 3:
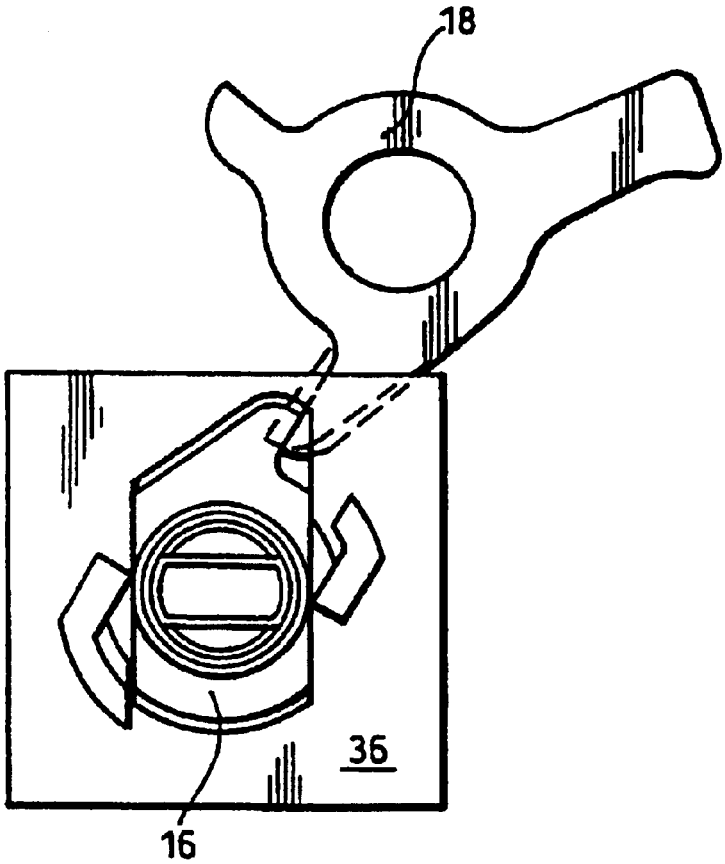

Pawl 18 includes an annular portion 19 having first arm 20, second arm 21, and third arm 22 projecting therefrom. A resilient means biases the pawl 18 in a clockwise direction as shown in FIG. 1A. Third arm 22 releasably engages the claw 8 to releasably retain it on its first latch position. Second arm 21 is acted upon by a lever (not shown) to move the pawl 18 from its first retaining position (FIG. 1A) to its second released position (FIG. 3). First arm 20 co-operates with the pawl retainer 16 as described below.

Figure 7:
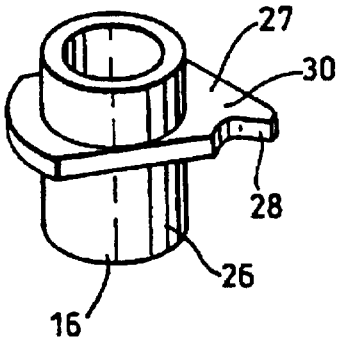
FIG. 7 shows the pawl retainer in isolation for clarity.

The pawl retainer 16 includes a cylindrical portion 26 having a planar portion 27 situated part way along the cylindrical portion 26 and projecting substantially perpendicularly relative to the axis of the cylindrical portion 26. The planar portion 27 includes a first abutment 28, a first planar surface 29 (see FIG. 8), a second planar surface 30 (see FIG. 7) and the cylindrical portion includes a slot 31 (see FIG. 1).

Figure 5:
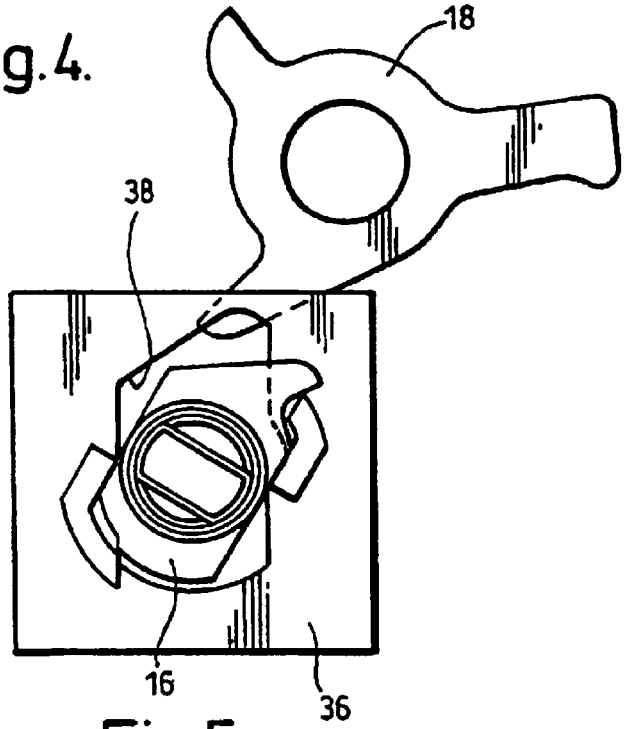
Figure 10:
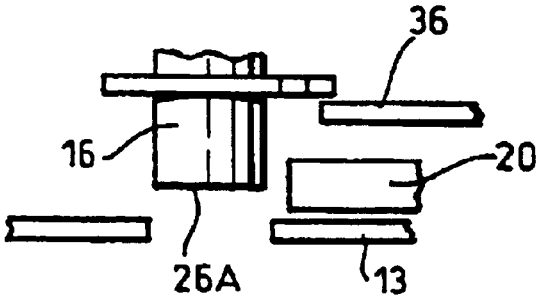

Fixed structure 36 is contained within the latch housing 13 (see FIG. 1*a* and FIG. 10) and includes a hole 38 best seen in FIG. 5 with abutment portions 40 (see FIG. 1A) and rotation stops 42. A bias means in the form of spring 32 biases the pawl retainer 16 in the direction of arrow A of FIG. 8.

Figure 2:
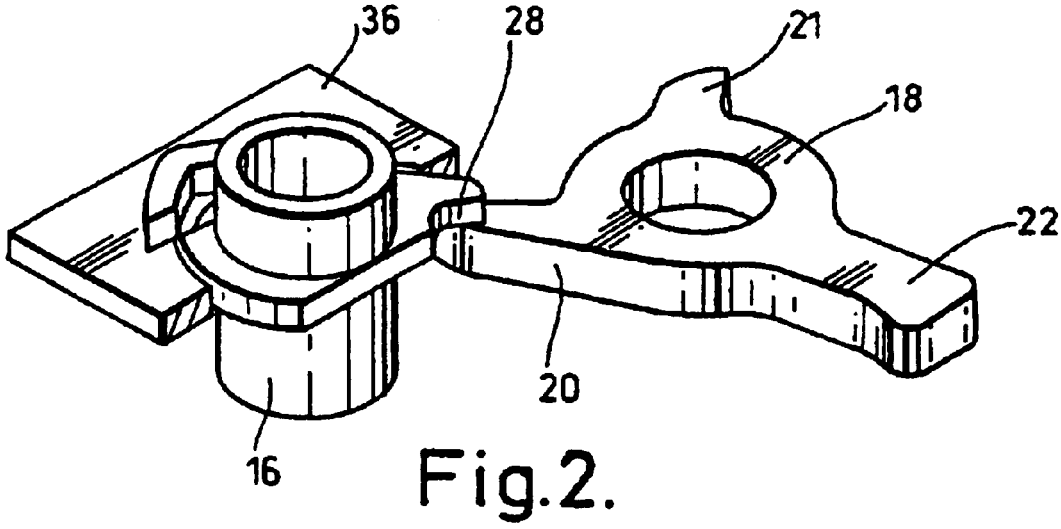
FIG. 2 is an isometric view of FIG. 1 shown with some of the fixed structure removed for clarity, FIGS. 3 and 4 correspond to FIGS. 1A and 2 with the pawl in a second released position and the pawl retainer in a second retaining position, FIGS. 5 and 6 correspond to FIGS. 1A and 2 with the pawl in the first retaining position and the pawl retainer in a third position.
Figure 8:
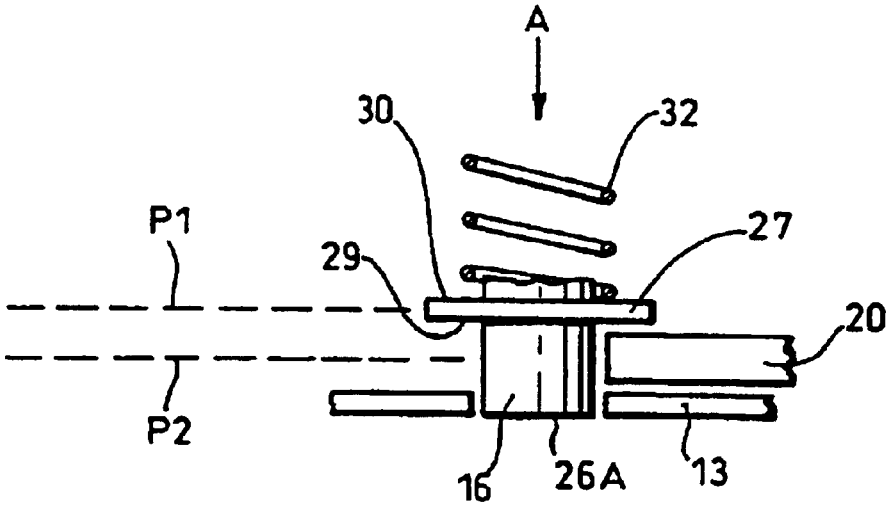
FIGS. 8, 9 and 10 show schematic views of the pawl retainer in a first released position, a second retaining position, and a third position respectively.

Operation of the latch assembly is as follows:

With reference to FIGS. 1A,2 and 8 the latch assembly 10 is shown in a closed position with an actuating portion of the pawl retainer 16, in the form of end 26A of the cylindrical portion 26, being substantially flush with the latch housing 13 and with the pawl 18 in its first retaining position wherein third arm 22 engages the claw 8 to retain the claw 8 in the first latched position. It should be noted that first planar surface 29 rests upon first arm 20 as a result of the spring 32 forcing the pawl retainer 16 in the direction of arrow A of FIG. 8. In this position the pawl retainer 16 is prevented from rotating by contact of edges of the planar portion 27 with the hole 38.

In particular the general plane P1 of the planar portion 27 is out of plane with respect to the general plane P2 of the pawl 18.

Figure 9:
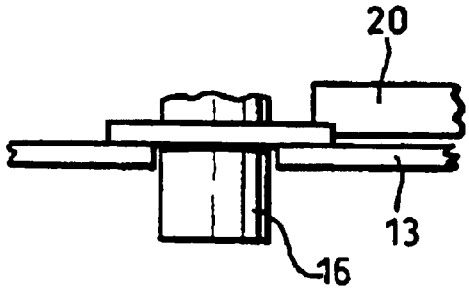

Operation of the boot release causes second arm 21 to be driven in an anticlockwise direction when viewing FIG. 1A to position as shown in the FIG. 3. wherein the first planar surface 29 of the planar portion 27 no longer rests on first arm 20 and is therefore biased by the spring 32 into the position shown most clearly in FIG. 9. In this position end 26A of the cylindrical portion 26 of the pawl retainer 16 stands proud of the latch housing 13 and the plane of the planar portion 27 is substantially in line with the plane P2 of the pawl 18.

Figure 4:
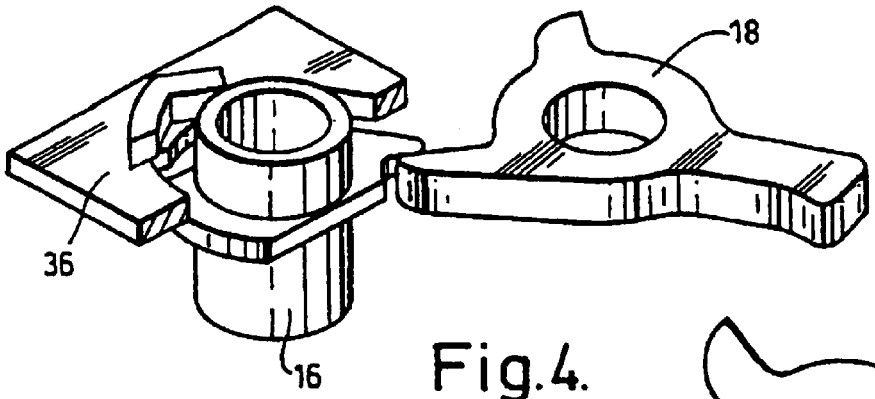

When the pawl retainer 16 is in its second retaining position as shown in FIGS. 3, 4 and 9 it is prevented from rotating by guide portions (not shown) and this ensures that the first arm 20.

In this position the pawl is incapable of retaining the claw in its first latched position thus when the boot is slammed shut and a striker 9 moves from the remote position R to the engaged position E and the claw achieves its latched position there is nothing to ensure it remains in its latched position and the boot will spring back open again under the influence of boot opening springs or the like.

In order to secure the boot closed two distinct actions need to take place:

a) Firstly the pawl retainer 16 must be moved from its second retaining position as shown in FIGS. 3, 4 and 9 to its first released position as shown in FIGS. 1A, 2 and 8. This is achieved by say thumb pressure on end 26A to move it substantially flush with the latch housing. Once in this position the resilient means acting upon the pawl rotates it in a clockwise direction to the position shown in FIG. 1A. Thumb pressure can then be removed from the end 26A and the first planarsurface 29 will abut first arm 20.

b) The boot lid is then subsequently slammed shut wherein the pawl rotates slightly in an anticlockwise direction as the claw passes third arm 22 but not sufficiently such that first arm 20 disengages first planar surface 29.

Thus this two stage operation is less likely to be achieved by a child especially when the latch is mounted on the boot lid which when in an open position moves the latch to a relatively high position out of reach of children.

Opening of the boot again in the pawl moving from the position shown in FIG. 1A all the way to the position shown in FIG. 3 and thus allowing the pawl retainer 16 to achieve its position as shown in FIGS. 3, 4 and 9 wherein first abutment 28 again retains the pawl 18 in this position thus ensuring that every time the boot is opened a dual action closing sequence is required as described above.

Figure 6:
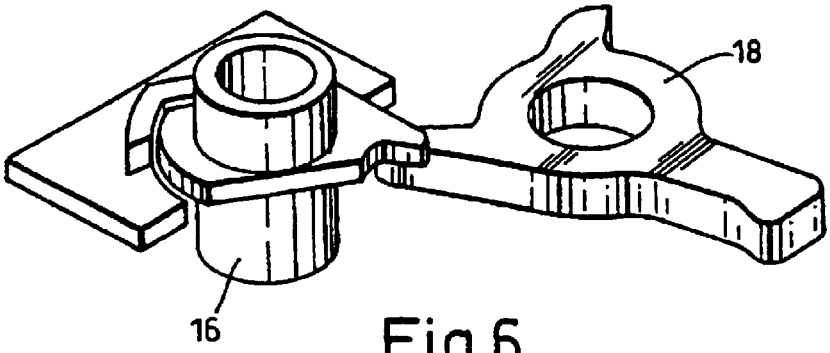

In the event that it is unlikely that children are to be trapped in the boot, the dual action closing sequence can be temporarily overridden. Thus by pushing the pawl retainer into the housing such that end 26A is recessed relative to the latch housing 13 and then subsequently rotating the pawl retainer such that first planar surface contacts the abutment portions 40 of the fixed structure 36 (see FIGS. 5, 6 and 10) the pawl retainer 16 can be temporarily maintained in this third position requiring only a slamming of the boot to secure it in its closed position.

The slot 31 can be conveniently used in conjunction with a screwdriver or even the automobile keys to move the pawl retainer 16 to and from its third position. It should be noted from FIG. 10 that the end 26A is recessed relative to the latched housing 13 thus preventing movement of the pawl retainer 16 to its third position inadvertently by thumb pressure.

It should further be noted that movement of the pawl retainer between its first release and second retained position is limited to linear movement, rotation being prevented by the hole 38 and also the guides, and movement between the first released position and the third position requires linear and rotational movement.

When the boot is open, the latch and in particular the end 26A of the pawl retainer is accessible for operation. However when the boot is closed access to end 26A is neither required nor possible since it is concealed behind the boot door skin or vehicle body. Thus no extra holes are required in the door skin/body and the features that provide for the dual action closing sequence can conveniently be incorporated in to the latch.

The foregoing description is only exemplary of the principles of the invention. Many modifications and variations of the present invention are possible in light of the above teachings. The preferred embodiments of this invention have been closed, however, so that one of ordinary skill in the art would recognize that certain modifications would come within the scope of this invention may be practiced otherwise than as specially described. For that reason the following claims should be studied to determine the true scope and content of this invention.

What is claimed is:

1. A latch comprising:

a latch bolt moveable between a latched position capable of retaining a striker in an engaged position and an unlatched position at which the striker is free to move between the engaged position and a remote position;

a first retainer that moves in a plane between a first retaining position retaining the latch bolt in the latched position and a second released position releasing the latch bolt from the latched position; and a second retainer having a planar portion with a first abutment that engages with the first retainer when the planar portion is in the plane of the first retainer to releasably retain the first retainer in the second released position after unlatching of the latch and to further retain the first retaining mechanism in the second released position after the striker moves from the remote position to the engaged position, wherein the first abutment disengages from the first retainer when the planar portion is moved out of the plane of the first retainer.

2. The latch as defined in claim 1, wherein the second retainer moves between at least a first released position where the second retainer releases the first retainer from the second released position and a second retaining position where the second retainer retains the first retainer in the second released position.

3. The latch as defined in claim 2, wherein the second retainer moves linearly between the first released position and the second retaining position.

4. The latch as defined in claim 3, further comprising at least one guide that prevents the second retainer from rotating when positioned at or between the first released position and the second retaining position.

5. The latch as defined in claim 2, further comprising a second bias mechanism that biases the second retaining mechanism towards the second retaining position.

6. The latch as defined in claim 2, further comprising a fixed structure that contacts the second retainer to prevent the second retainer from moving past the second retaining position.

7. The latch as defined in claim 2, further comprising a fixed structure having a fixed structure abutment, wherein the second retainer is temporarily retained in a third position by contact with the fixed structures abutment, wherein the second retainer releases the first retainer from the second released position when in the third position.

8. The latch as defined in claim 7, wherein the second retainer rotates when moving to or from the third position.

9. The latch as defined in claim 7, wherein the first abutment of the second retainer is positioned on a same side of the plane when the second retainer is in the first released position and the third positions.

10. The latch as defined in claim 2, wherein an actuating portion of the second release mechanism stands proud of adjacent structure or adjacent structure of the latch when the second release mechanism is in the second retaining position.

11. The latch as defined in claim 2, wherein an actuating portion of the second release mechanism is substantially flush with adjacent structure or adjacent structure of the latch when the second release mechanism is in the first released position.

12. The latch as defined in claim 7, wherein an actuating portion of the second release mechanism is recessed into adjacent structure or adjacent structure of the latch when the second release mechanism is in the third position.

13. The latch as defined in claim 1, wherein the second retaining mechanism is a pawl retainer.

14. The latch as defined in claim 1, wherein the first retainer rotates between the first retaining position and the second released position.

15. The latch as defined in claim 1, wherein the first retainer is biased towards the first position by a first biased mechanism.

16. The latch as defined in claim 1, wherein the first retainer is a pawl.

17. The latch as defined in claim 1, wherein the latch bolt rotates between the first latched position and the second unlatched position.

18. The latch as defined in claim 1, wherein the latch bolt is biased towards the second unlatched position by a latch bias mechanism.

19. The latch as defined in claim 1, wherein the latch bolt is a claw.

20. A vehicle latching system including a latch comprising:

a striker;

a latch bolt moveable between a latched position capable of retaining the striker in an engaged position and an unlatched position at which the striker is free to move between the engaged position and a remote position;

a first retainer moveable in a plane between a first retaining position to retain the latch bolt in the latched position and a second released position to release the latch bolt from the latched position; and a second retainer having a planar portion with a first abutment that engages with the first retainer when the planar portion is in the plane of the first retainer to releasably retain the first retainer in the second released position after unlatching of the latch and to further retain the first retainer in the second released position after the striker moves from the remote position to the engaged position, wherein the first abutment disengages when the first portion is moved out of the plane.

21. The vehicle latching system as defined in claim 20, wherein the latch system is a boot latching system that secures a vehicle boot lid.

22. The vehicle latching system as defined in claim 21, wherein the latch is mounted on the boot lid of the vehicle.

23. The vehicle latching system as defined in claim 21, wherein the second retaining mechanism is not accessible when the boot lid is closed.

* * * * *